United States Patent [19]

Cunnane

[11] Patent Number: 4,865,083

[45] Date of Patent: Sep. 12, 1989

[54] SEAMED MULTI-LAYERED PAPERMAKER'S FABRIC

[75] Inventor: Francis J. Cunnane, Greer, S.C.

[73] Assignee: Asten Group, Inc., Charleston, S.C.

[21] Appl. No.: 212,035

[22] Filed: Jun. 23, 1988

Related U.S. Application Data

[63] Continuation of Ser. No. 66,139, Jun. 24, 1987, abandoned.

[51] Int. Cl.[4] ..... D03D 23/00

[52] U.S. Cl. ..... 139/383 A; 28/141; 139/408; 162/DIG. 1

[58] Field of Search ..... 28/141, 142; 24/33 P, 24/33 C; 139/383 A, 383 AA, 408, 409; 162/DIG. 1

[56] References Cited

U.S. PATENT DOCUMENTS

| | | | |
|---|---|---|---|
| 1,750,493 | 3/1930 | Spencer | 139/383 A |
| 1,812,148 | 6/1931 | Hindle | 139/408 |
| 1,963,898 | 6/1934 | Hainsworth | 139/408 |
| 2,907,093 | 10/1959 | Draper, Jr. | 28/141 |
| 2,949,134 | 8/1960 | Hindle et al. | 139/383 A X |
| 3,238,594 | 3/1966 | Schuster | 28/141 |
| 3,815,645 | 6/1974 | Codorniu . | |
| 4,141,388 | 2/1979 | Romanski et al. | 139/383 AA |
| 4,182,381 | 1/1980 | Gisbourne | 139/383 AA |
| 4,186,780 | 2/1980 | Josef et al. . | |
| 4,267,226 | 5/1981 | Kohler et al. | 139/383 AA X |
| 4,403,632 | 9/1983 | Romanski et al. | 139/383 A |
| 4,438,788 | 3/1984 | Harwood | 139/383 A |
| 4,438,789 | 3/1984 | MacBean | 139/383 AA |
| 4,574,435 | 3/1986 | Luciano et al. | 139/383 AA X |
| 4,658,863 | 4/1987 | Errecart . | |

FOREIGN PATENT DOCUMENTS

| | | | |
|---|---|---|---|
| 0012519 | 6/1980 | European Pat. Off. . | |
| 398577 | 9/1933 | United Kingdom | 139/383 A |
| 1266891 | 3/1972 | United Kingdom | 28/141 |
| 2090788 | 7/1982 | United Kingdom . | |

*Primary Examiner*—Robert R. Mackey
*Attorney, Agent, or Firm*—Volpe and Koenig

[57] ABSTRACT

A seam is provided for a papermaker's felt for use in a papermaker's machine. The seam joins a felt having at least four layers of machine direction yarns in which at least two layers at each end of the felt are finished in loops, and the remaining layers are finished with or without loops. The loops of the ends to be joined are mated, and a pintle is inserted to close the seam.

3 Claims, 2 Drawing Sheets

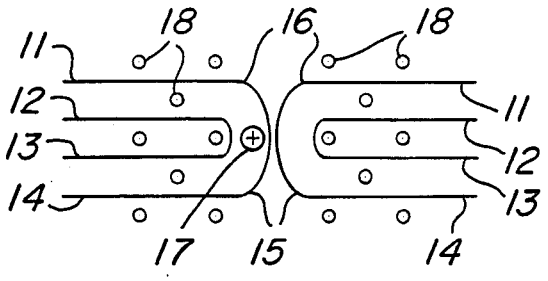
FIG. 1
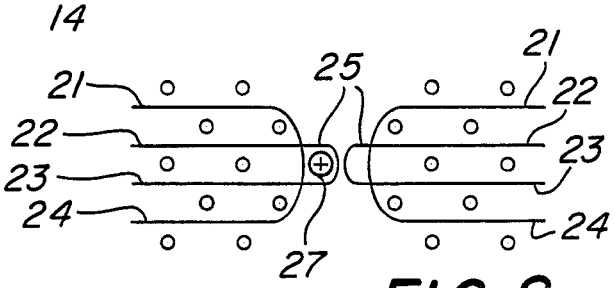
FIG. 2
FIG. 3
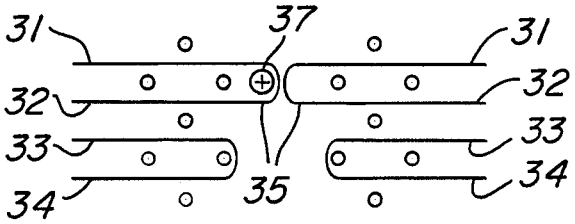
FIG. 4
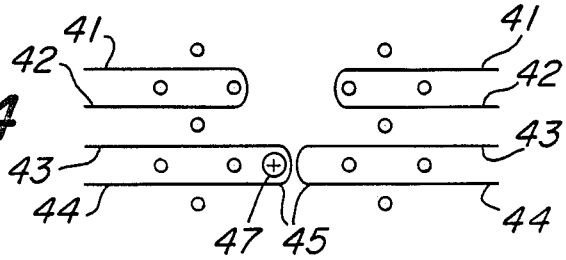
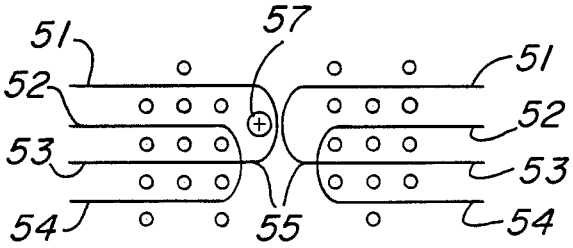
FIG. 5
FIG. 6
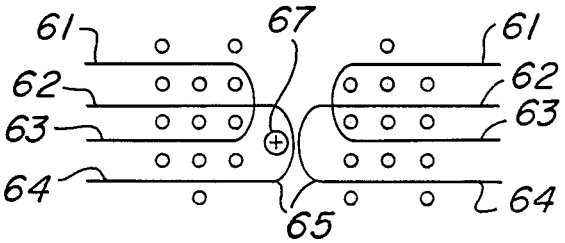

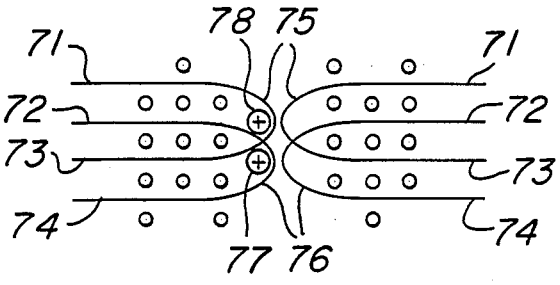
FIG. 7
FIG. 8
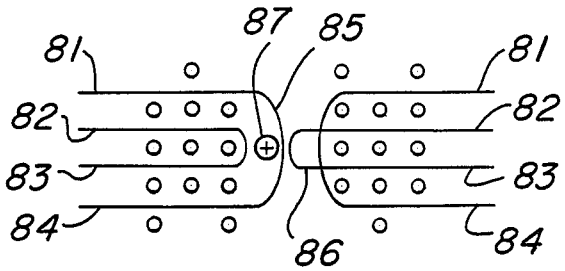
FIG. 9
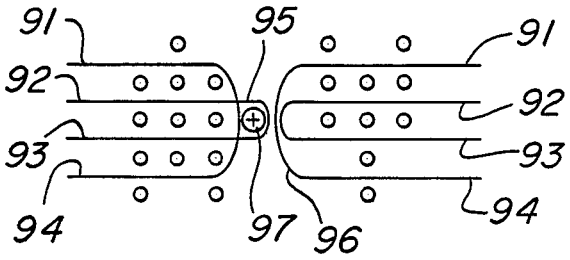
FIG. 10
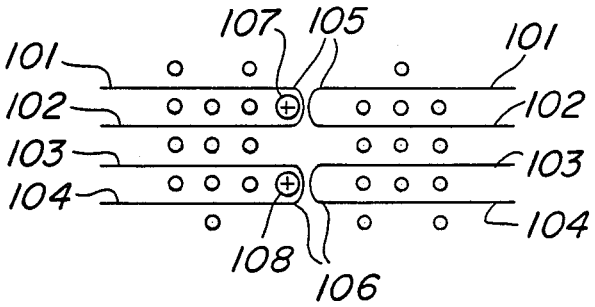
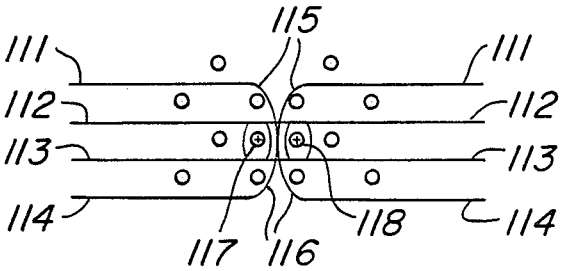
FIG. 11

SEAMED MULTI-LAYERED PAPERMAKER'S FABRIC

This application is a continuation of application Ser. No. 066,139, filed 6/24/87, now abandoned.

BACKGROUND OF THE INVENTION

The present invention relates to a seam for a multi-layer felt for use in a papermaking machine. The felts typically employed in a papermaking machine are manufacture either as a continuous loop or a flat woven felt. Often, papermaking felts are woven as a flat fabric which may be joined at two ends by a seam. Typical seams for a papermaker's felt comprise a plurality of spaced apart loops on each end of the felt to be joined which are mated in an intermeshing alternating relationship to form a substantially tubular channel through which a pintle is inserted in closing the seam.

As papermaking machines have developed, machine felt speeds of between 4000 and 5000 feet per minute have become common. Due to such high speeds, and resulting forces on the seam as well as the hostile conditions of temperature, pressure and environment to which such seams are exposed, seam durability is of concern. Also of concern, is the effect the seam design has upon the properties of the felt. For example, attempts to increase seam strength by increasing the diameter of the pintle requires increasing the diameter of the loops which results in an increased thickness for the felt in the seam area. Such increased thickness can result in imperfections in the product being produced as well as cause vibrations, due to imbalance, during running of the machine. Also, other properties of the felt, such as void volume which is directly related to the amount of water the felt can absorb, can be affected by such seams. This is of particular concern in felts used in wet press sections to a papermaking machine.

In the manufacture of certain paper grades such as pulp, corrugating medium and cylinder boards, sensitivity to seam marking is not a great concern. In such areas, the time necessary to install the fabric on the machine is of concern. For such applications, the improved properties of a multi-layer felt are desired, however, the multiple pintle seams of such felts are undesirable due to the time involved in insertion of the pintles. In such areas, where seam marking is not a primary concern, multi-layer felts which are relatively easy to install have not previously been available.

SUMMARY OF THE INVENTION

The present invention provides a method of seam formation for a felt weave having at least four machine direction layers in which the geometry of the seam can be easily adapted to provide for a variety of seams. In the method of seam formation of the present invention, a woven base fabric having at least four layers in the machine direction, is provided with connecting loops at each end to be joined which finish at least two of the layers. By altering the choice of which of the layers are finished in loops, the geometry of the resulting seam can be easily varied.

BRIEF DESCRIPTION OF THE DRAWINGS

FIG. 1 is a cross section of an opened felt seam of the present invention.

FIG. 2 is a cross section of an alternate embodiment of an opened felt seam of the present invention.

FIG. 3 is a cross section of an alternate embodiment of an opened felt seam of the present invention.

FIG. 4 is a cross section of an alternate embodiment of an opened felt seam of the present invention.

FIG. 5 is a cross section of an alternate embodiment of an opened felt seam of the present invention.

FIG. 6 is a cross section of an alternate embodiment of an opened felt seam of the present invention.

FIG. 7 is a cross section of an alternate embodiment of an opened felt seam of the present invention.

FIG. 8 is a cross section of an alternate embodiment of an opened felt seam of the present invention.

FIG. 9 is a cross section of an alternate embodiment of an opened felt seam of the present invention.

FIG. 10 is a cross section of an alternate embodiment of an opened felt seam of the present invention.

FIG. 11 is a cross section of an alternate embodiment of a closed felt seam of the present invention.

DETAILED DESCRIPTION OF THE PREFERRED EMBODIMENT

In the present invention, a woven fabric having at least four plies in the machine direction (MD) is provided with loops extending from the MD yarns of two of the plies. The yarns of the remaining MD plies are finished in a manner so as to not form loops. The present seam for a multi-ply fabric allows for a number of variations to be produced as shown in the drawings.

In FIG. 1, a four-ply fabric is formed from machine direction yarn layers 11, 12, 13 and 14 woven With cross machine direction (CMD) yarns 18. At each end 16 of the four-ply woven base 10, the outside MD layers 11 and 14 are finished in loops 15. The inside MD layers 12 and 13 are finished without loops. The formation of loops 15 from MD layers 11 and 14 may be accomplished by folding a single MD yarn back upon itself to form two MD layers, 11 and 14. MD layers 11 and 14 may be formed from a single MD yarn in a similar fashion. The loops 15 formed on the ends of woven base 10 to be joined are adapted to intermesh in an alternating fashion, as will be known to those skilled in the art. The ends 16 are mated, forming a channel, not shown, through which a pintle, represented by 17, is inserted to close the seam.

The preferred embodiment shown in FIG. 1 allows for loops 15 to be relatively large so as to ease insertion of pintle 17. Also, the larger loops 15 allow a larger pintle 17 to be employed Although, the size of the loops 15 or pintle 17 is larger than CMD yarns 18, the felt thickness at the seam area is not increased. This results because the base fabric is four-ply, and the loops are formed from only two plies, thereby maintaining seam caliper and preventing marking of the product to be produced.

In a related embodiment, as shown in FIG. 2, the outside MD layers 21 and 24 are finished without loops, while the inside MD layers 22 and 23 are finished so as to form loops 25.

The alternate embodiment shown in FIG. 2 orients the pintle 27 within loops 25 which, in use, are substantially surrounded by the non-loop forming plies of the four ply base. When the loops 25 are intermeshed, the thicker ends of the non-loop forming layers 21 and 24 substantially surround the loops 25 This protects the loops 25 and pintle 27 from excessive abrasive wear during use allowing a smaller pintle to provide an acceptable seam.

With reference to FIG. 3, loops 35 are formed from an outside MD layer 31 and the adjacent MD layer 32. The remaining MD layers 33 and 34 are finished without a loop. FIG. 4 is a mirror image of FIG. 3 in which MD layers 43 and 44 are formed into loops 45 and remaining layers 41 and 42 are finished so as to not form loops.

With respect to FIG. 5, loops 55 are formed from an outside MD layer 51 and the non-adjacent inside MD layer 53, with the remaining MD layers 52 and 54 finished so as to not form a loop. FIG. 6 is a mirror image of FIG. 5 in which outside MD layer 64 and the non-adjacent inside MD layer 62 are formed into loops 65. The remaining MD layers 61 and 63 are finished so as not to form loops.

In FIG. 7, a two pintle embodiment of the present invention is shown. First loops 75 are formed from non-adjacent MD layers 71 and 73. The remaining non-adjacent MD layers 72 and 74 form loops 76. When the ends 75 and 76 are mated, pintles 77 and 78 are inserted to closed the seam.

In FIG. 10, an alternate two pintle embodiment of the present invention is shown First loops 105 are formed from adjacent MD layers 101 and 102. The remaining non-adjacent MD layers 103 and 104 form loops 106. Loops 105 are oriented directly above loops 106 such that upon closing of the seam pintle 107 is oriented directly above pintle 108.

FIGS. 8 and 9 show alternate embodiments of the present invention which employ a single pintle, 87 and 97 respectively, in which the ends to be joined are complementary rather than mirror images In FIG. 8, a first loop 85 is formed from MD layers 81 and 84 while a second loop 86 is formed from MD layers 82 and 83. In FIG. 9, a first loop 95 is formed from MD layers 92 and 93 while a second loop 96 is formed from MD layers 91 and 94.

FIG. 11 shows an alternate embodiment in which the ends to be joined are mirror images and woven so that a spiral or coil loop element 116 may be intermeshed with the respective ends 115 to be joined. Thereafter, at least two pintles 117 and 118 are inserted within the respective ends of spiral 116 and the ends 115, closing the seam.

In the Figures, cross machine direction yarns, designated 18 in FIG. 1, are shown merely as representative of possible weave patterns for a four-ply fabric A variety of weave patterns could be employed in practicing the present invention, as would be known to a person skilled in the art. Acceptable weave patterns would include a repeat which allowed the MD layers to be woven back on themselves to form the loops as illustrated in the Figures.

Typically, the four-ply woven base fabric of the present invention is provided with one or more layers of non-woven batt material. The batt layers may be affixed to the woven base fabric in a manner known in the art, such as by needling.

As can be seen, the present invention allows the formation of loops to receive a pintle or pintles in a four MD ply fabric which allows the geometry of the resulting seam to be adjusted to provide acceptable service in a variety of conditions. The loops are typically formed by folding a MD yarn back upon itself to form a loop and a second MD layer. By varying which two layers are to be finished in loops, seams having different geometries can be produced. While the present invention has been described and illustrated with relation to a fabric having four MD plies, it may easily be adapted to fabrics having an even number of plies greater than four.

It should be understood that the foregoing description and drawings of the invention are not intended to be limiting, but are only exemplary of the inventive features which are defined in the claims.

What I claim is:

1. A papermakers multi-layer fabric which is seamed into an endless fabric by mating loops extending from the woven base of the fabric to define a pintle channel, said fabric comprising a plurality of cross machine direction yarns and at least four machine direction yarn layers wherein at least two machine direction layers are formed by a first machine direction yarn which is woven in a first machine direction layer, finished in loops at each end of said fabric and woven in a second machine direction layer and at least two other machine direction layers are formed by a second machine direction yarn which is woven in a third machine direction layer, finished without loops and woven in a fourth machine direction layer, said loops at each end of said fabric intermeshed to define the pintle channel.

2. The fabric of claim 1, wherein outer non-adjacent machine direction yarn layers are woven in said loops and inner adjacent machine direction yarn layers are woven without loops.

3. A papermakers multi-layer fabric which is seamed into an endless fabric by mating loops extending from the woven base of the fabric to define a pintle channel, said fabric comprising a plurality of cross machine direction yarns and at least four machine direction yarn layers wherein at least two machine direction layers are formed by a single machine direction yarn which is woven in a first machine direction layer, finished in loops at each end of said fabric and woven in a second machine direction layer and at least two other machine direction layers are formed by a single machine direction yarn which is woven in a third machine direction layer, finished without loops and woven in a fourth machine direction layer, said loops at each end of said fabric intermeshed to define the pintle channel.

* * * * *

UNITED STATES PATENT AND TRADEMARK OFFICE

CERTIFICATE OF CORRECTION

PATENT NO. : 4,865,083

DATED : September 12, 1989

INVENTOR(S) : Francis J. Cunnane

It is certified that error appears in the above-identified patent and that said Letters Patent is hereby corrected as shown below:

At column 1, lines 11 and 12, delete the word "manufacture" and insert therefor --manufactured--.

At column 1, line 38, delete the word "to" and insert therefor --of--.

At column 2, line 31, delete the word "With" and insert therefor --with--.

At column 2, line 38, delete reference numerals "11 and 14", second occurrence and insert therefor --12 and 13--.

At column 2, line 49, after the word "employed" and before the word "Although" insert --.--.

At column 2, line 65, after reference numeral 25 and before the word "This" insert --.--.

At column 3, line 23, after the word "shown" and before the word "First" insert --.--.

At column 3, line 32, after the word "images" and before the word "In" insert --.--.

UNITED STATES PATENT AND TRADEMARK OFFICE

CERTIFICATE OF CORRECTION

PATENT NO. : 4,865,083

DATED : September 12, 1989

INVENTOR(S) : Francis J. Cunnane

It is certified that error appears in the above-identified patent and that said Letters Patent is hereby corrected as shown below:

At column 3, line 47, after the word "fabric" and before the word "A" insert --.--.

Signed and Sealed this

Tenth Day of July, 1990

*Attest:*

HARRY F. MANBECK, JR.

*Attesting Officer*

*Commissioner of Patents and Trademarks*